US010480893B2

(12) United States Patent
McPherson

(10) Patent No.: US 10,480,893 B2
(45) Date of Patent: Nov. 19, 2019

(54) CROSSBOW WITH STOCK OVERLAP

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 15/934,865

(22) Filed: Mar. 23, 2018

(65) Prior Publication Data

US 2018/0274878 A1 Sep. 27, 2018

Related U.S. Application Data

(60) Provisional application No. 62/476,583, filed on Mar. 24, 2017.

(51) Int. Cl.
*F41B 5/12* (2006.01)
*F41C 23/00* (2006.01)

(52) U.S. Cl.
CPC ..... *F41B 5/123* (2013.01); *F41C 23/00* (2013.01)

(58) Field of Classification Search
CPC ..... F41B 5/105; F41B 5/12; F41B 5/123
USPC ..... 124/25, 900
See application file for complete search history.

(56) References Cited

U.S. PATENT DOCUMENTS 3,486,495 A 12/1969 Allen
4,722,317 A * 2/1988 Hartwig ..... F41B 5/10 124/25.6
4,766,874 A * 8/1988 Nishioka ..... F41B 5/12 124/25
4,879,987 A * 11/1989 Nishioka ..... F41B 5/123 124/25
5,678,528 A * 10/1997 Hadley ..... F41B 5/12 124/24.1
7,743,760 B2 * 6/2010 Woodland ..... F41B 5/0094 124/25
7,891,348 B2 * 2/2011 Colley ..... F41B 5/123 124/25
8,387,604 B1 * 3/2013 Terzo ..... F41B 5/123 124/23.1
8,522,762 B2 * 9/2013 Trpkovski ..... F41B 5/0094 124/25.6
8,607,773 B1 * 12/2013 Schultz ..... F41B 5/123 124/25
9,255,753 B2 * 2/2016 Pulkrabek ..... F41B 5/105
9,297,604 B1 * 3/2016 Sidebottom ..... F41B 5/123
9,377,267 B1 * 6/2016 Kempf ..... F41B 5/105
9,383,159 B2 * 7/2016 Pulkrabek ..... F41B 5/1469
9,389,041 B2 * 7/2016 Novikov ..... F41B 7/00
9,494,379 B2 * 11/2016 Yehle ..... F41B 5/105
9,513,080 B1 * 12/2016 Kempf ..... F41B 5/123
9,719,749 B1 * 8/2017 Prior ..... F41B 5/0094
9,921,026 B1 * 3/2018 Anderson ..... F41B 5/1469
(Continued)

*Primary Examiner* — Alexander R Niconovich

(57) ABSTRACT

In some embodiments, a crossbow comprises a stock, a fire control assembly and a bow portion. In some embodiments, the bow portion comprises a prod, a first limb, a second limb, a first rotatable member and a second rotatable member. The crossbow comprises a drawn orientation wherein the first rotatable member overlaps with the stock. In some embodiments, a reference line oriented orthogonal to a shooting axis intersects the stock and the first rotatable member. In some embodiments, the reference line is parallel to a rotation axis of the first rotatable member.

19 Claims, 5 Drawing Sheets

(56) References Cited

U.S. PATENT DOCUMENTS

| | | | | |
|---|---|---|---|---|
| 2011/0041820 | A1* | 2/2011 | Stanziale | F41B 5/105<br>124/25 |
| 2011/0056467 | A1* | 3/2011 | Popov | F41B 5/0094<br>124/25.6 |
| 2012/0125302 | A1* | 5/2012 | Stanziale | F41B 5/123<br>124/25 |
| 2013/0312724 | A1* | 11/2013 | Hudkins | F41B 5/123<br>124/25 |
| 2017/0160042 | A1* | 6/2017 | Yehle | F41B 5/123 |
| 2018/0051954 | A1* | 2/2018 | Yehle | F41B 5/066 |
| 2018/0172394 | A1* | 6/2018 | Trpkovski | F41B 5/12 |

* cited by examiner

CROSSBOW WITH STOCK OVERLAP

CROSS-REFERENCE TO RELATED APPLICATIONS

This application claims the benefit of U.S. Patent Application No. 62/476,583, filed Mar. 24, 2017, the entire content of which is hereby incorporated herein by reference.

BACKGROUND OF THE INVENTION

This invention relates generally to crossbows and more specifically to compound crossbows having rotating members.

Crossbows are generally known in the art. It can be desirable to minimize the physical dimensions of a crossbow, provided that the crossbow delivers suitable firing, speed and longevity characteristics.

Traditionally, crossbows have been relatively wide because an archery bow is positioned across a stock. A width dimension of the crossbow can be related to the size of the bow portion of the crossbow. For example, a limb tip to limb tip dimension for non-compound crossbows, and an axle-to-axle dimension for compound crossbows can be related to the width of the crossbow.

There remains a need for novel crossbow designs that provide for smaller external crossbow dimensions while still delivering suitable performance characteristics.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a crossbow comprises a stock, a fire control assembly and a bow portion. In some embodiments, the bow portion comprises a prod, a first limb, a second limb, a first rotatable member and a second rotatable member. The crossbow comprises a drawn orientation wherein the first rotatable member overlaps with the stock. In some embodiments, a reference line oriented orthogonal to a shooting axis intersects the stock and the first rotatable member. In some embodiments, the reference line is parallel to a rotation axis of the first rotatable member.

In some embodiments, a distance between the first rotatable member and the second rotatable member in the drawn condition is less than a width of the stock.

In some embodiments, a portion of the first rotatable member passes through a sidewall of the stock.

In some embodiments, the stock comprising a single piece of material.

In some embodiments, a crossbow comprises a stock and a bow portion comprising a rotatable member, and the rotatable member overlaps with the stock.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
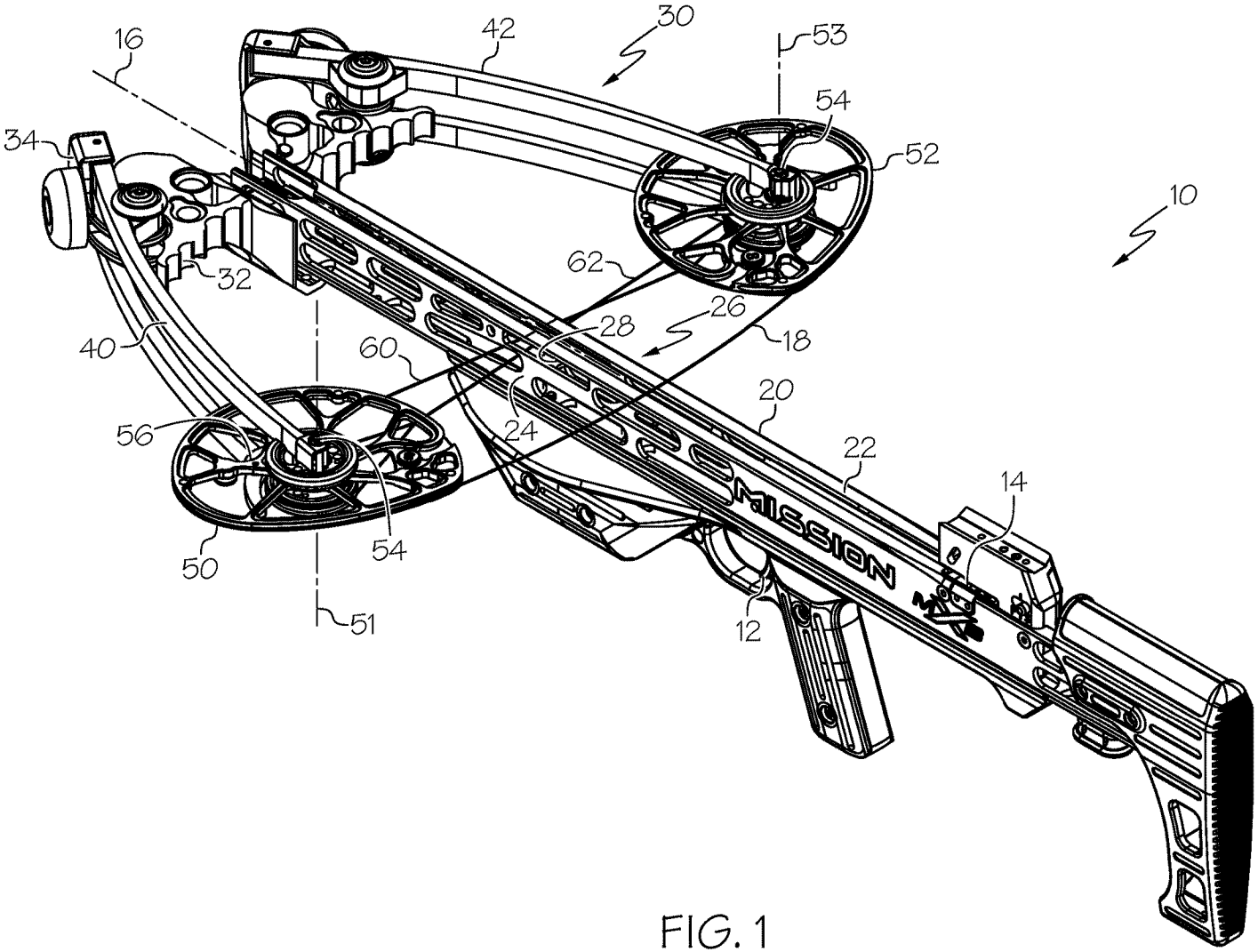
FIG. 1 shows an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
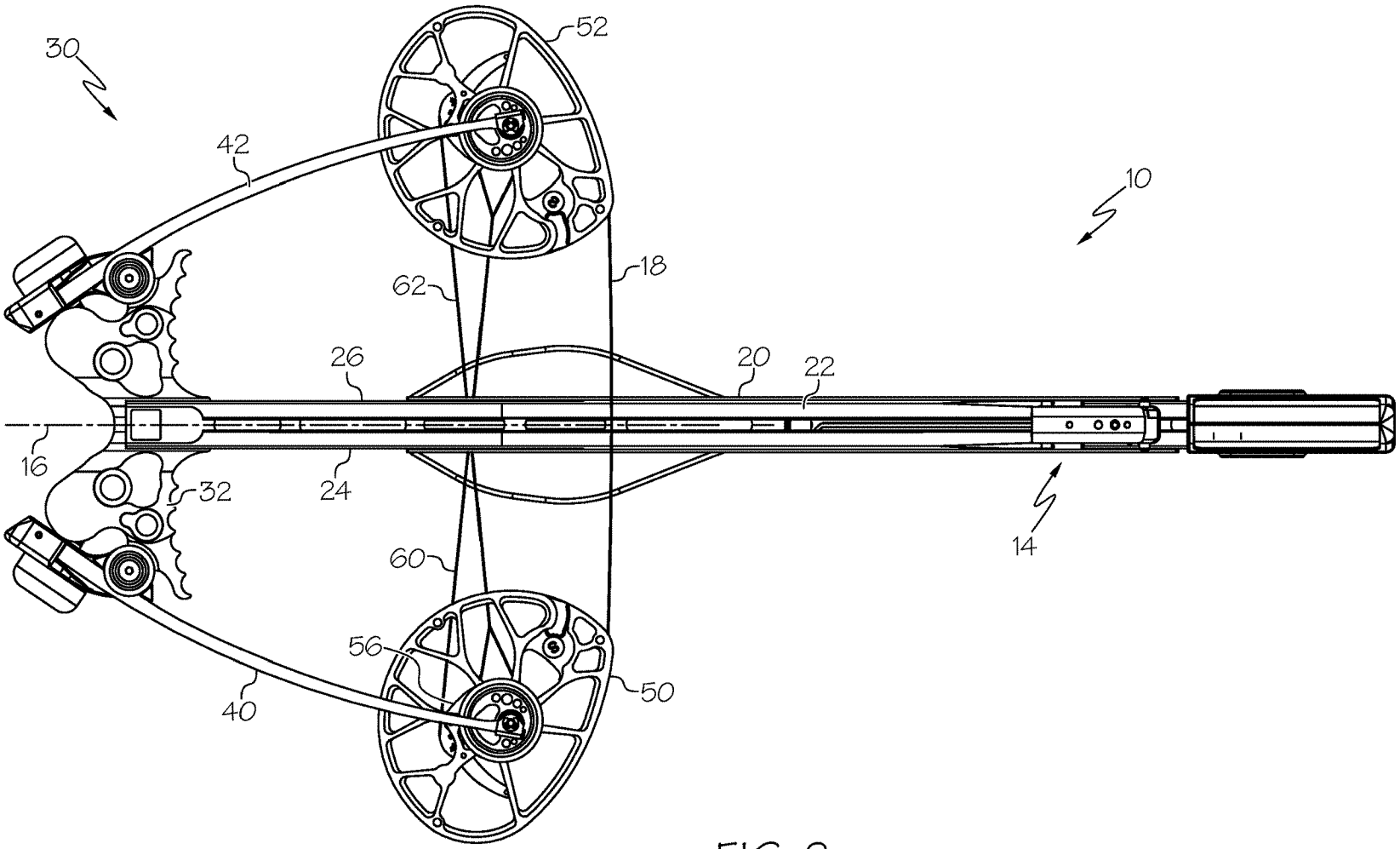
FIG. 2 shows a top view of the crossbow of FIG. 1.

FIGS. 1 and 2 show an embodiment of a crossbow 10 in an undrawn or brace condition.

In some embodiments, a crossbow 10 comprises a stock 20, a trigger 12, a latch 14 and a bow portion 30. Desirably, the bow portion 30 comprises a bowstring 18, and the crossbow 10 stores energy as the bowstring 18 is drawn. Desirably, the bowstring 18 can be retained in a drawn configuration by the latch 14. Desirably, the trigger 12 is arranged to cause the latch 14 to release the bowstring 18 upon actuation of the trigger 12.

In some embodiments, the bow portion 30 comprises a prod 32. In some embodiments, the prod 32 is attached to the stock 20. In some embodiments, the prod 32 supports a first limb 40 and a second limb 42, and the limbs 40, 42 are arranged to flex and store energy as the bowstring 18 is drawn. In some embodiments, the prod 32 supports a limb cup 34, and the limb cup 34 supports a limb 40.

In some embodiments, the bow portion 30 comprises a first rotatable member 50 and a second rotatable member 52. In some embodiments, the first limb 40 supports the first rotatable member 50 and the second limb 42 supports the second rotatable member 52. Desirably, the first rotatable member 50 is arranged to rotate about a first rotation axis 51, and the second rotatable member is arranged to rotate about a second rotation axis 53. In some embodiments, a limb 40, 42 supports an axle 54, and a rotatable member 50, 52 is rotatably mounted upon the axle 54.

In some embodiments, the bow portion 30 comprises a compound bow. In some embodiments, a rotatable member 50 comprises a cam 56. In some embodiments, the bow portion 30 comprises a power cable 60 that is arranged to be taken up on the cam 56 as the bowstring 18 is drawn.

In some embodiments, the bow portion 30 can comprise any suitable type of compound bow, such as a single cam bow, a cam-and-a-half bow, a two cam bow, etc. FIGS. 1 and 2 show an embodiment of a two cam bow, wherein the power cable 60 is a first power cable 60 and the bow portion 30 further comprises a second power cable 62.

In some embodiments, as the bowstring 18 is drawn, the limbs 40, 42 flex and the rotation axes 51, 53 of the rotatable members 50, 52 move inward, for example in a direction toward the shooting axis 16. In some embodiments, a distance between the first rotation axis 51 and the second rotation axis 53 decreases as the bowstring 18 is drawn.

In some embodiments, the stock 20 comprises a first side surface 24 and a second side surface 26. In some embodiments, each side surface 24, 26 comprises a plurality of apertures 28. In some embodiments, the first side surface 24 extends parallel to the second side surface 26. In some embodiments, a width of the stock 20 comprises a distance between the first side surface 24 and the second side surface 26.

Figure 3:
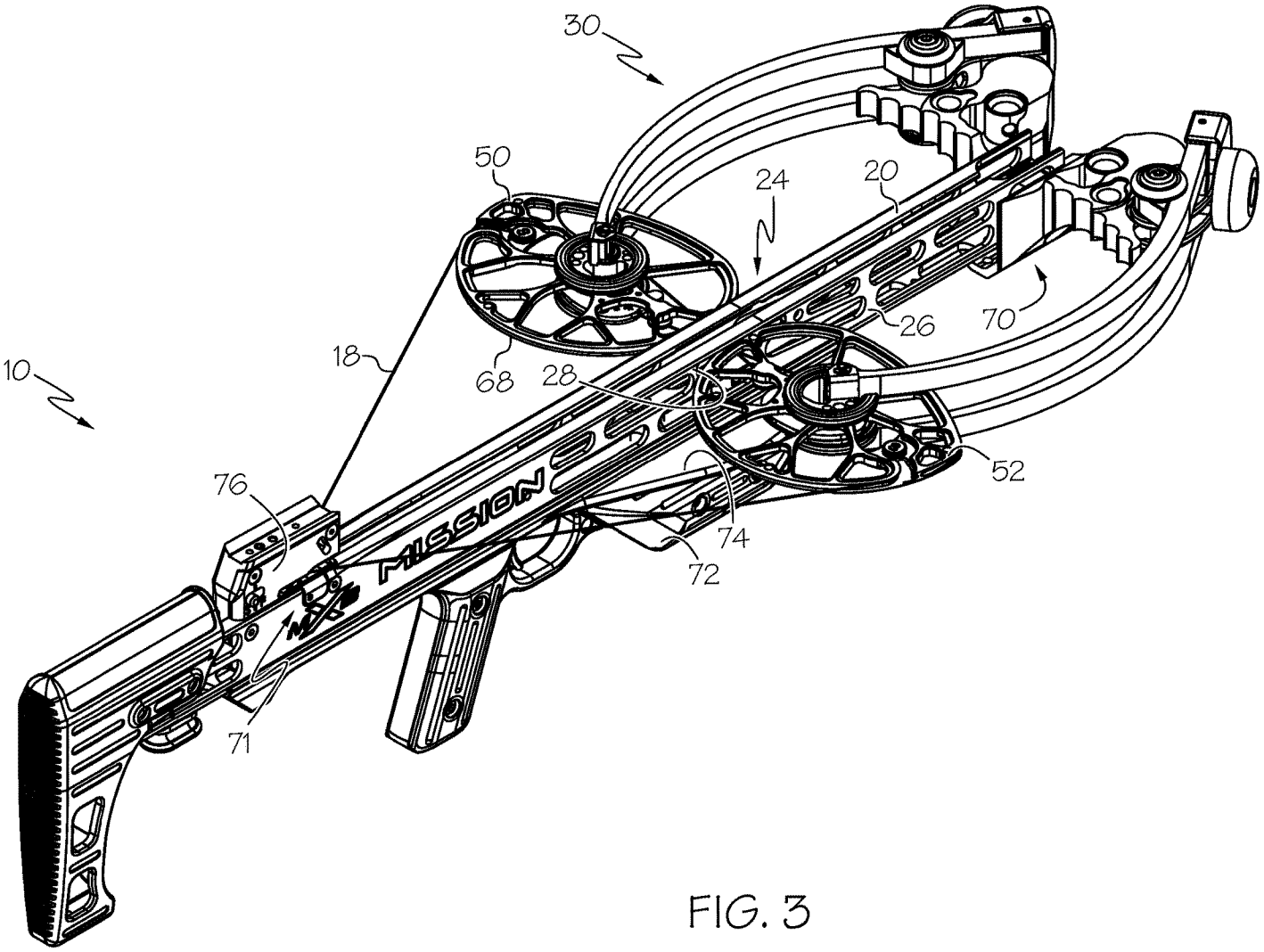
FIG. 3 shows the crossbow of FIG. 1 in a drawn orientation.
Figure 4:
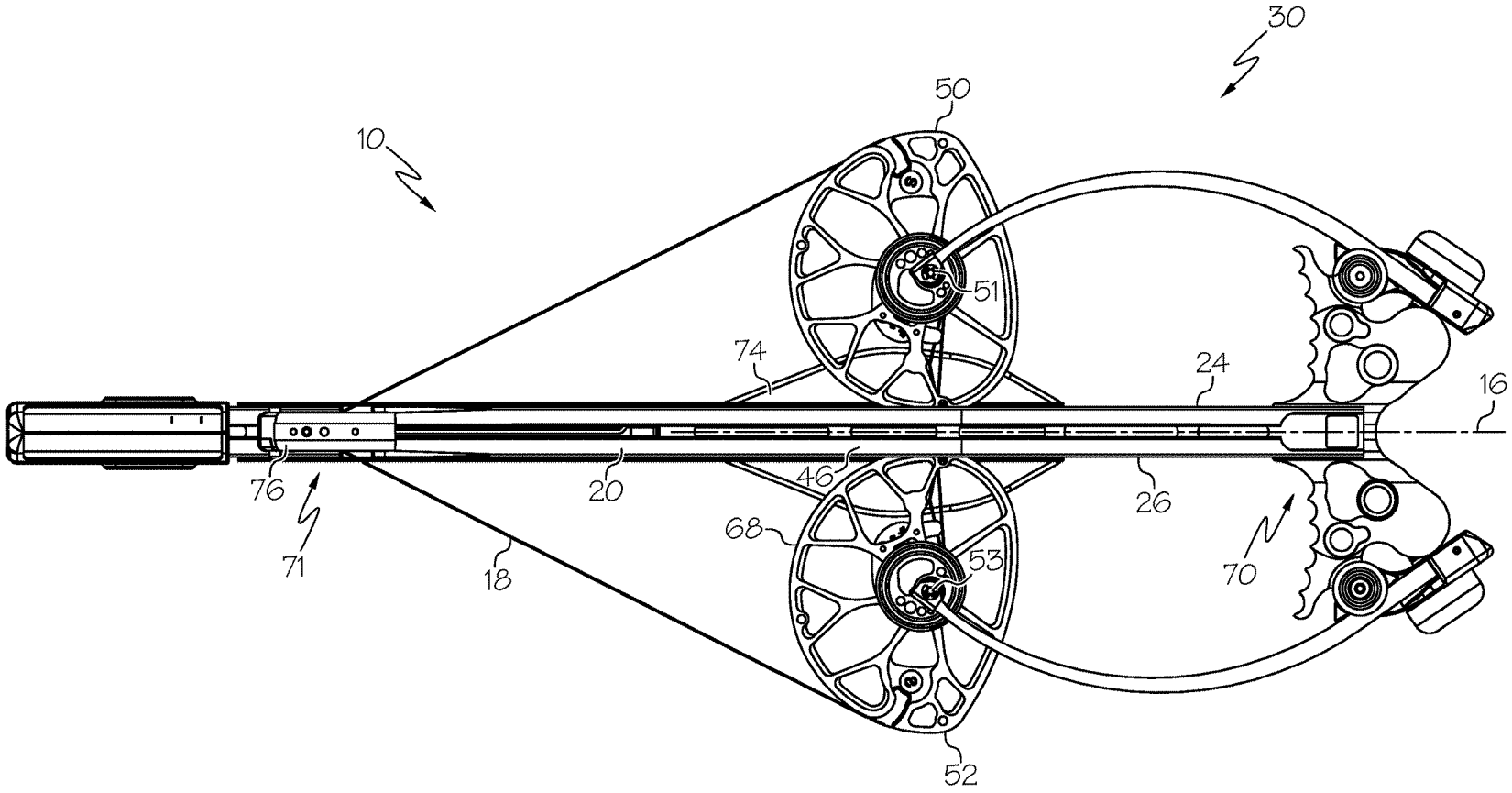
FIG. 4 shows a top view of the crossbow of FIG. 3.
Figure 5:
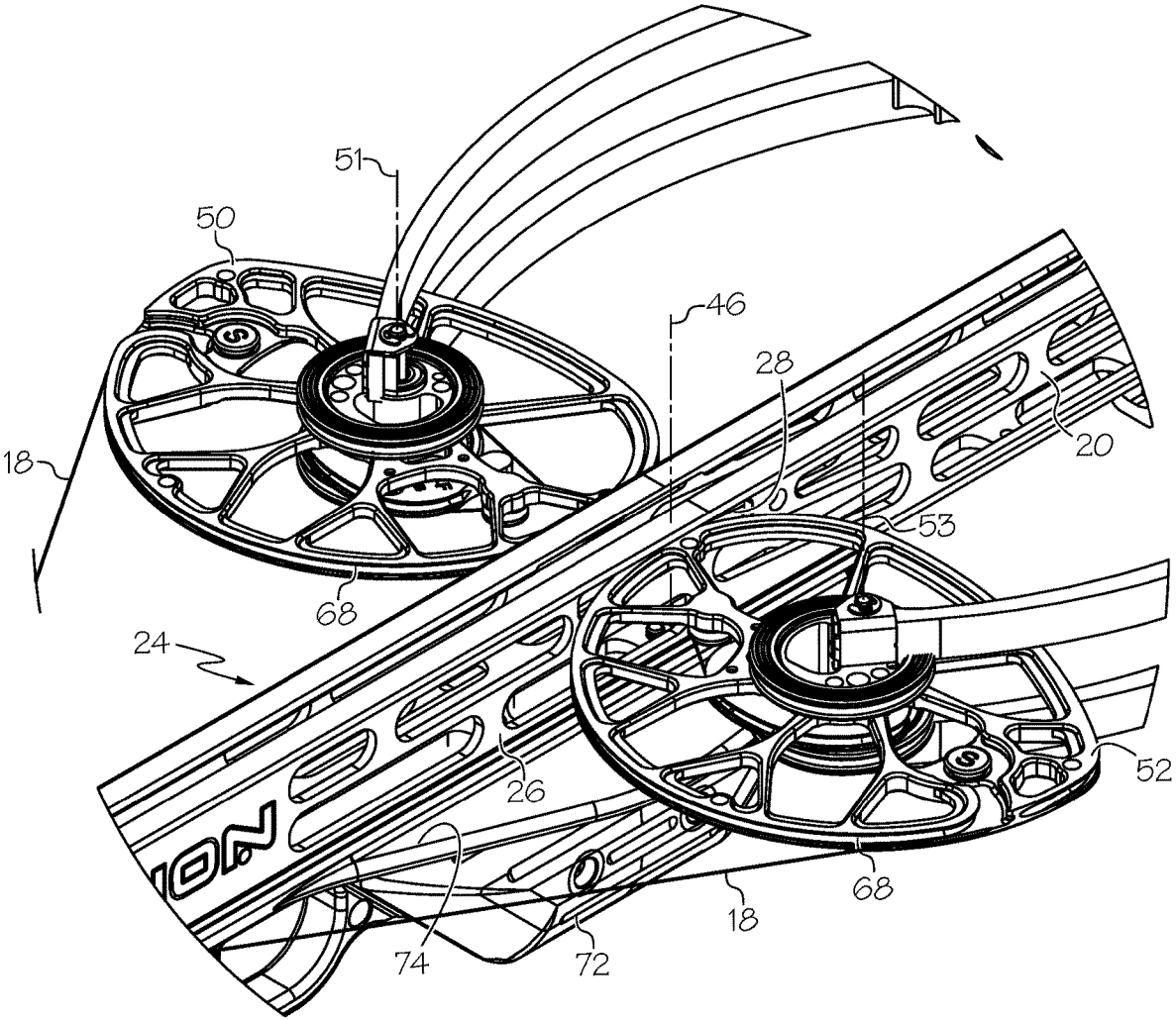
FIG. 5 shows a detail of the crossbow as shown in FIG. 3.

FIGS. 3-5 show the crossbow 10 of FIG. 1 in a drawn condition, wherein the latch 14 is engaged with the bowstring 18, and the crossbow 10 is retained in a drawn orientation.

In some embodiments, the rotatable members 50, 52 move inward during draw. In some embodiments, at least one rotatable member 50, 52 overlaps with the stock 20 during at least a portion of a draw cycle. In some embodiments, each rotatable member 50, 52 overlaps with the stock 20 during at least a portion of the draw cycle.

In some embodiments, the stock 20 defines a width dimension, and one or more rotatable members 50, 52 overlaps with the width dimension during at least a portion of the draw cycle. In some embodiments, the first side 24 of the stock 20 defines a plane, and a portion of the first rotatable member 50 is oriented in the plane during at least a portion of the draw cycle. In some embodiments, the second side 26 of the stock 20 defines a plane, and a portion of the second rotatable member 52 is oriented in the plane during at least a portion of the draw cycle.

In some embodiments, a distance between the first rotatable member 50 and the second rotatable member 52 is less than the width of the stock 20. In some embodiments, the distance comprises the shortest distance between the rotatable members 50, 52.

In some embodiments, the stock 20 comprises an aperture 28, and a portion of a rotatable member 50, 52 is oriented in the aperture 28 during at least a portion of the draw cycle. In some embodiments, the first side 24 of the stock 20 comprises an aperture 28, and a portion of the first rotatable member 50 is oriented in the aperture 28 during at least a portion of the draw cycle. In some embodiments, the second side 26 of the stock 20 comprises an aperture 28, and a portion of the second rotatable member 52 is oriented in the aperture 28 during at least a portion of the draw cycle.

In some embodiments, a rotatable member 50, 52 comprises a bowstring track 68. In some embodiments, a bowstring track 68 extends around an outer periphery of a rotatable member 50, 52. In some embodiments, a portion of the bowstring track 68 overlaps with the stock 20 during at least a portion of the draw cycle. In some embodiments, a portion of the bowstring track 68 extends through a sidewall 24 of the stock 20. In some embodiments, a portion of a bowstring track 68 is oriented in an aperture 28 in the stock 20.

In some embodiments, a reference line 46 (see FIGS. 4 and 5) arranged to intersect the stock 20 will also intersect a rotatable member 50, 52 during at least a portion of the draw cycle. In some embodiments, the reference line 46 is oriented orthogonal to the shooting axis 16. In some embodiments, the reference line 46 is oriented orthogonal to a length of the stock 20. In some embodiments, the reference line 46 is oriented vertically when the shooting axis 16 is oriented horizontally. In some embodiments, the reference line 46 is oriented parallel to a side (e.g. 24, 26) of the stock 20. In some embodiments, the reference line 46 is oriented parallel a rotation axis 51, 53.

In some embodiments, the stock 20 comprises a cavity, blind hole or the like, and a portion of a rotatable member 50, 52 is oriented in the cavity during at least a portion of the draw cycle.

In some embodiments, a distance between the shooting axis 16 and a side 24, 26 of the stock 20 is greater than a distance between the shooting axis 16 and a rotating member 50, 52.

In some embodiments, the stock 20 as discussed herein comprises a structural member of the crossbow 10. In some embodiments, the stock 20 is placed into compression when the crossbow 10 is cocked. In some embodiments, compression and/or bending forces are applied to the stock 20 by the bow portion 30 between a first portion or location 70 of the stock 20 and a second portion or location 71 of the stock 20. In some embodiments, the first portion 70 comprises a location where the prod 32 is attached to the stock 20. In some embodiments, the second portion 71 comprises a location where a fire control assembly 76 is attached to the stock 20. The first control assembly 76 can comprise the latch 14, which receives forces from the bowstring 18, and the fire control assembly 76 transfers forces to the stock 20. In some embodiments, the overlap between the stock 20 and the rotatable members 50, 52 is located along a length of the stock 20 between the first portion 70 and the second portion 71. In some embodiments, the stock 20 comprises a single piece of material having a portion extending between the first portion 70 and the second portion 71.

In some embodiments, a crossbow 10 comprises a handgrip 72, finger guards 74 or other similar components, and these components are supported by the stock 20 but are not considered to be a part of the stock 20 for the purposes of overlap discussed herein. In some embodiments, the stock 20 comprises a structural component of the crossbow 10 that comprises a single piece of material.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a stock comprising a structural portion;

a fire control assembly attached to the stock;

a bow portion attached to the stock, the bow portion comprising a prod, a first limb, a second limb, a bowstring segment, a first rotatable member and a second rotatable member, the bowstring segment arranged to unspool from the first rotatable member and the second rotatable member as the crossbow is drawn;

the crossbow comprising a drawn orientation wherein the first rotatable member overlaps with the structural portion of the stock and a portion of the first rotatable member passes through a sidewall of the stock.

2. The crossbow of claim 1, wherein a reference line oriented orthogonal to a shooting axis intersects the stock and the first rotatable member.

3. The crossbow of claim 1, wherein the first rotatable member overlaps with the stock.

4. The crossbow of claim 3, wherein a distance between the first rotatable member and the second rotatable member in the drawn condition is less than a width of the stock.

5. The crossbow of claim 1, the sidewall comprising an aperture, a portion of the first rotatable member oriented in the aperture.

6. The crossbow of claim 1, comprising a non-drawn orientation wherein the first rotatable member does not overlap with the stock.

7. The crossbow of claim 1, the stock comprising a single piece of material.

8. The crossbow of claim 1, the stock comprising a structural component of the crossbow that receives applied forces from the bow portion at a first location and a second location.

9. The crossbow of claim 8, the first location comprising an attachment between the prod and the stock.

10. The crossbow of claim 9, the second location comprising an attachment between the first fire control assembly and the stock.

11. A crossbow comprising:

a stock comprising a structural portion, a bow portion comprising a rotatable member and a bowstring segment arranged to unspool from the rotatable member as the crossbow is drawn;

wherein the rotatable member overlaps with the structural portion of the stock and a portion of the first rotatable member passes through a sidewall of the stock.

12. The crossbow of claim 11, wherein a side of the stock defines a plane, and a portion of the rotatable member is oriented in the plane.

13. The crossbow of claim 11, wherein a side of the stock comprises an aperture, and a portion of the rotatable member is oriented in the aperture.

14. The crossbow of claim 11, wherein a side of the stock comprises a cavity, and a portion of the rotatable member is oriented in the cavity.

15. The crossbow of claim 11, wherein a reference line intersects the stock and the rotatable member.

16. The crossbow of claim 15, wherein the reference line is oriented orthogonal to a shooting axis of the crossbow.

17. The crossbow of claim 15, wherein the reference line is oriented parallel to a rotation axis of the rotatable member.

18. The crossbow of claim 11, the stock comprising a single piece of material.

19. The crossbow of claim 11, the bow portion comprising a limb, the rotatable member supported by the limb.

* * * * *